United States Patent [19]

Korte et al.

[11] 4,364,486

[45] Dec. 21, 1982

[54] PLUG-TYPE BOTTLE CLOSURE (PLASTIC CORK)

[76] Inventors: Rolf D. Korte, Domäne Dommelhof, 3543 Diemelsee-Ottlar; Wilfried Rohlje, Sassmickerhammer 41, 5690 Olpe, both of Fed. Rep. of Germany

[21] Appl. No.: 282,160

[22] Filed: Jul. 10, 1981

[30] Foreign Application Priority Data

Jul. 24, 1980 [DE] Fed. Rep. of Germany ..... 3027995

[51] Int. Cl.[3] ..... B65D 39/04; B65D 39/16

[52] U.S. Cl. ..... 215/296; 215/307

[58] Field of Search ..... 215/296, 297; 220/284

[56] References Cited

FOREIGN PATENT DOCUMENTS 1607901 9/1970 Fed. Rep. of Germany .
1106988 7/1955 France .
1127460 8/1956 France .

*Primary Examiner*—Donald F. Norton
*Attorney, Agent, or Firm*—Karl F. Ross

[57] ABSTRACT

A plug-type closure for a bottle, e.g. a wine bottle "cork" consists of a unitary circular cross section plug having a thin-wall core spacedly surrounded by the outer member and a plurality of radial webs bridging the outer member core. The core is formed with a cork-screw-shaped cavity including a screw-shaped groove whose depth and radius decreases progressively toward the bottom of the plug.

5 Claims, 2 Drawing Figures

PLUG-TYPE BOTTLE CLOSURE (PLASTIC CORK)

FIELD OF THE INVENTION

Our present invention relates to a plug-type bottle closure of synthetic resin material and, more particularly, to a wine bottle "cork".

BACKGROUND OF THE INVENTION

Plug-type closure for bottles, composed unitarily of synthetic resin material, have been provided heretofore as a substitute for conventional bottle closures composed of cork. These plug-type closures are themselves frequently referred to as "corks" and can comprise an outer circular-cross sectional relatively thin-walled outer member, e.g. a hollow cylinder, connected at its bottom by an end wall to a cylindrical core member disposed centrally of the plug.

The core can be provided with a preformed corkscrew-shaped cavity into which a corkscrew can be driven to facilitate withdrawal of the plug from the neck and mouth of the bottle. Radial webs can be formed unitarily with the core and the hollow cylinder to bridge them in angularly equally spaced relationship.

These synthetic-resin or plastic corks can be used to close wine bottles at the end of the bottling process and can be of the type described in French Pat. No. 1 106 988.

In this arrangement the internal cavity is formed as a cylindrical bore in the wall of which a groove of helical configuration is provided of screwthread configuration, i.e. constant pitch, constant radius and constant depth by turning methods, e.g. of the type well known in the production of female screwthreads in the metal.

Such expensive fabrication techniques must be used because for practical reasons, the complex-shaped internal cavity cannot be fabricated during injection molding of the plug. If injection molding techniques are used, the plug cannot be removed from the core-forming member of the mold or can only be removed by expensive or complex manipulations.

Furthermore, when efforts are made to use conventional corkscrews or like tools to withdraw the cork from the neck and mouth of the bottle, the shape of the corkscrew is frequently not compatible with the shape of the cavity or groove and the cork-pulling stress can be applied nonuniformly so that the corkscrew frequently pulls free and/or the cork is damaged.

Another bottle cork of the plastic type is described in French Pat. No. 1 127 460. Here the webs lie tangentially at the corkscrew-receiving member so that the disadvantages enumerated above with respect to handling and fabrication are present as well.

Still another plastic cork is described in German patent document No. DE-OS No. 16 07 901. In this construction in place of a helical groove, the cavity is formed with a multiplicity of semi-circular disks which are spaced apart in accordance with the pitch of the turns of the corkscrew so that diagonal disk edges can project between the turns and enable the cork to be withdrawn from the bottle.

Difficulties have been encountered with this system since the corkscrew does not engage the disks with sufficient precision to avoid damage upon the execution of a pull on the corkscrew. Furthermore the same problem creates difficulties in the threading of the corkscrew into the cork. In the fabrication of such a cork, moreover, it is frequently necessary to assemble the plug from two parts which are individually injection molded and then joined together. This fabrication technique is obviously expensive.

OBJECTS OF THE INVENTION

It is the principal object of the present invention to provide an improved plastic bottle cork or plug-type closure especially for wine bottles wherein the disadvantages of earlier systems are obviated.

Another object of this invention is to provide a plastic cork into which a corkscrew can be inserted more rapidly and with greater precision than with earlier closures which can accommodate standard commercial corkscrews, and which can be fabricated in a single piece, i.e., unitarily by injection molding techniques without problem with respect to removal of the plug after molding.

SUMMARY OF THE INVENTION

These objects and others which will become apparent hereinafter are attained, in accordance with the present invention, in a plug-type closure or plastic cork formed unitarily of synthetic resin material, e.g. polyethylene, which comprises an outer circular-cross section and preferably cylindrical member, an inner relatively thick-wall core member and a plurality of angularly equally spaced radial ribs or walls bridging the gap between these members, the members being interconnected as well by a bottom wall of the plastic cork, an elongated cavity within the core member opening at the opposite end of the plastic cork and adapted to receive a commercial cork screw.

According to the invention the cavity has a downwardly tapering conical passage in the wall of which is formed a generally helical or spiral groove whose flanks converge away from the axis of the passage and which is of progressively decreasing radius (measured from this axis) from the open end of the cavity toward the closed end thereof, the axial width and preferably also the cross section of the groove decreasing in this direction as well.

The helical cavity thus provided can be easily formed by injection molding the plug-shape body onto a core from which by virtue of the combination of features described, the body can be axially withdrawn from the form in a simple manner.

To enable the body to be inserted readily into the neck of a bottle, the closed end or bottom is formed with a conical bevel.

To prevent the plastic cork from being forced excessively into the neck of the bottle and below the mouth, the outer member is formed in the region of its upper edge, with an abutment shoulder which seats against the mouth of the bottle.

It has also to be advantageous so as to simplify insertion and withdrawal of the plastic cork to form the outer wall thereof with at least one and preferably with a plurality of angularly spaced axial grooves which reach from the top of the frustoconical bevel to a region just below this shoulder. Since this invention allows the radiuses and tapers required for injection molding techniques to be provided at all critical locations, the plug body can be formed by conventional injection molding techniques.

The outer wall of the hollow cylinder can be formed by one mold member which can also carry individual cores adapted to form the spaces between the radial walls while the helical cavity can be formed by a second part of the mold or tool. Alternatively, a separate mold member can form the spaces between the radial walls.

In the system of the invention, these spaces and the helical cavity are open upwardly, i.e. open in the direction opposite the closed bottom of the cork.

This does not create any problems because, when the cork is used for wine bottles, it is customary to cover the upper end of the cork with a cap or with foil. Of course a cover can be bonded to the upper end of the cork when it is desired to close the latter, e.g. by cementing the cover thereto. Where a cover is provided it can be pierced by the corkscrew, i.e. the corkscrew inserted through the cover.

An important advantage of the device of the present invention is that the helical cavity more closely conforms to conventional corkscrew shapes, whether the corkscrew proper has a cross section which has rounded edges or is of polygonal cross section.

BRIEF DESCRIPTION OF THE DRAWING

The above and other objects, features and advantages of the present invention will become more readily apparent from the following description reference being made to the accompanying drawing in which.

SPECIFIC DESCRIPTION

Figure 1:
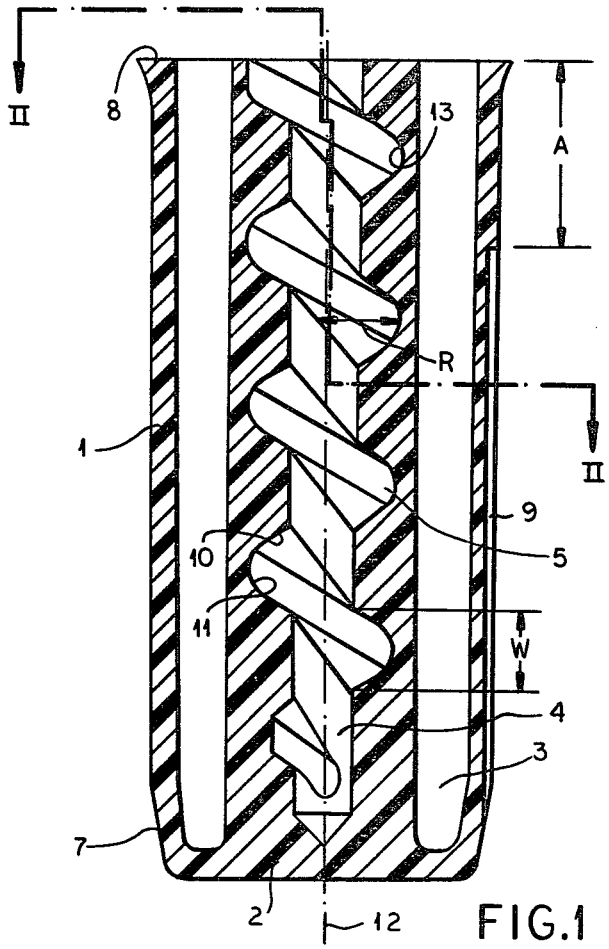
FIG. 1 is an axial section through a plastic cork embodying the invention.
Figure 2:
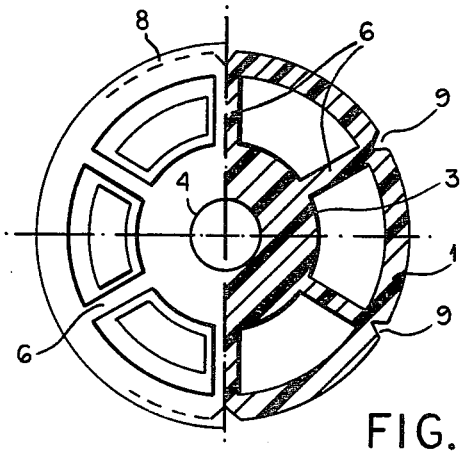
FIG. 2 is a view taken generally along the line II—II of FIG. 1 showing the plastic cork partly in an end view and partly in transverse section.

The bottle cork shown in FIGS. 1 and 2 is formed in one piece of synthetic resin material and is especially intended as a closure for wine bottles.

It can consist essentially of a hollow cylinder or circular thin-wall outer member 1 on which a bottom is molded to connect this member to thick-walled core 3 extending axially from this bottom which is also referred to herein as the closed end of the plug-shaped body formed by the members 1, 2 and 3.

The core 3 is formed with a helical axially extending cavity, closed at the bottom, and adapted to receive a corkscrew.

The core 3 is also connected by integral radial ribs or walls 6 to the hollow cylinder 1.

The plastic cork is usually formed from a synthetic resin which is limitedly deformable, e.g. is composed of polyethylene, to enable the deformability of the cork to permit the latter to be inserted into the neck of a bottle and seal against the inner wall thereof. In addition the body has sufficient stability so that when the plug is pulled, it is withdrawn without significant deformation or damage from the bottle and thus can be reused.

The cavity comprises a conically tapering central passage or shaft 4 and a helical groove 5 formed in the wall of this passage.

The flanks 10 and 11 of the passage converge away from the axis 12 of the body.

According to the invention, the groove radius R, i.e. the distance of the root 13 of the groove from the axis, decreases progressively downwardly, as does the axial width W of the groove, i.e. the groove opening. The cross section of the groove likewise decreases downwardly.

The body, i.e. the hollow cylinder 1 is formed in the region of the body 2 with an external conical bevel 7 to facilitate insertion of the plug into the bottle.

At the open upper end of the plug the angular shoulder 8 extends outwardly from the hollow cylinder 1 to engage a lip along the mouth of the bottle and prevent insertion into the neck to an excessive degree.

Air-vent grooves are formed in angularly equally spaced relationship around the exterior of the hollow cylinder 1 and extend axially from the region of the bottom 2 or the conical bevel 7 upwardly to a sufficient distance A from the shoulder 8 to prevent entry of air into the bottle when the plug is fully inserted but such that the bottle is vented during initial insertion of the plug or thereafter an initial withdrawal movement of the plug by the corkscrew.

We claim:

1. A plastic bottle cork comprising a unitary elongated body of synthetic-resin material formed with a hollow cylindrical outer member, a closed bottom, an axially extending core member connected to said bottom, and a plurality of angularly spaced radial walls bridging said members, said core member being formed with an elongated cavity closed in the region of said bottom and opened at the opposite end of said body, said cavity being formed with a passage conically tapering from said end toward said bottom, and a helical groove formed in the wall of said passage and having outwardly convergent flanks, the radius of said groove and the groove opening progressively diminishing from said end toward said bottom.

2. The plastic bottle cork defined in claim 1 wherein said hollow cylindrical member is formed externally at said bottom with a frustoconical taper away from said end.

3. The plastic bottle cork defined in claim 1 wherein said hollow cylindrical member is formed at said end with an outwardly projecting shoulder forming an abutment for the mouth of a bottle into which said body is insertable.

4. The plastic bottle cork defined in claim 1, claim 2 or claim 3 wherein said hollow cylindrical member is formed externally with at least one axially extending groove running from a point spaced from said end toward said bottom.

5. The plastic bottle cork defined in claim 4 wherein a plurality of such axially extending grooves are formed in said hollow cylindrical member in an angularly equally spaced relationship.

* * * * *